US009562504B2

(12) United States Patent
Tanabe et al.

(10) Patent No.: US 9,562,504 B2
(45) Date of Patent: Feb. 7, 2017

(54) FUEL PUMP FOR AN INTERNAL COMBUSTION ENGINE

(75) Inventors: Yosuke Tanabe, West Bloomfield, MI (US); Jason Abbas, Farmington Hills, MI (US); George Saikalis, West Bloomfield, MI (US)

(73) Assignee: Hitachi, Ltd, Tokyo (JP)

( * ) Notice: Subject to any disclaimer, the term of this patent is extended or adjusted under 35 U.S.C. 154(b) by 1179 days.

(21) Appl. No.: 13/423,528

(22) Filed: Mar. 19, 2012

(65) Prior Publication Data

US 2013/0243636 A1 Sep. 19, 2013

(51) Int. Cl.

| | |
|---|---|
| ***F04C 2/08*** | (2006.01) |
| ***F02M 63/02*** | (2006.01) |
| ***F02M 59/12*** | (2006.01) |
| ***F02M 59/36*** | (2006.01) |
| ***F04C 2/18*** | (2006.01) |
| ***F04C 14/26*** | (2006.01) |

(52) U.S. Cl.

CPC ..... *F02M 63/0245* (2013.01); *F02M 59/12* (2013.01); *F02M 59/366* (2013.01); *F02M 63/0265* (2013.01); *F04C 2/088* (2013.01); *F04C 2/18* (2013.01); *F04C 14/26* (2013.01); *F04C 2210/1044* (2013.01)

(58) Field of Classification Search

CPC ..... F04C 2/084; F04C 2/088; F04C 14/26; F04C 2270/60; F04C 2/18; F04C 2210/1044; F02M 59/12; F02M 59/366; F02M 63/0245; F02M 63/0265

USPC ..... 417/310, 278, 279; 418/180, 189–190, 418/206.5, 206.1, 270; 123/445, 510–511

See application file for complete search history.

(56) References Cited

U.S. PATENT DOCUMENTS

| | | | | |
|---|---|---|---|---|
| 2,088,882 A | | 8/1937 | Trimmer | |
| 2,365,636 A | | 12/1944 | Hedges | |
| 2,669,840 A | * | 2/1954 | Joy | 60/371 |
| 2,742,862 A | * | 4/1956 | Banker | F04C 14/26 418/126 |
| 2,845,031 A | * | 7/1958 | Guibert | 418/190 |
| 3,385,276 A | | 5/1968 | Reiners et al. | |

(Continued)

FOREIGN PATENT DOCUMENTS

| | | |
|---|---|---|
| FR | 415.071 | 9/1910 |
| FR | 2 854 220 A1 | 10/2004 |

(Continued)

OTHER PUBLICATIONS

European Search Report dated Jul. 2, 2013; 6 pages.

*Primary Examiner* — Devon Kramer
*Assistant Examiner* — Joseph Herrmann
(74) *Attorney, Agent, or Firm* — Mattingly & Malur, P.C.

(57) ABSTRACT

A fuel pump for a direct injection internal combustion engine having a housing defining a pump chamber. Driven and idler toothed gears are rotatably mounted within the pump chamber so that the driven and idler gears are in mesh with each other at a predetermined location in the pump chamber. A fluid inlet is formed through the housing and open to an inlet subchamber in the pump chamber. A fluid outlet is also formed through the housing and open to an outlet subchamber in the pump chamber. A pressure relief passageway fluidly connects the inlet subchamber to the outlet subchamber and a valve is disposed in series with the pressure relief passageway. A control circuit controls the actuation of the valve to control the pump pressure at the pump outlet.

12 Claims, 8 Drawing Sheets

(56) References Cited

U.S. PATENT DOCUMENTS

| | | | | |
|---|---|---|---|---|
| 3,981,646 | A * | 9/1976 | Bottoms | 418/190 |
| 5,224,839 | A * | 7/1993 | Cardillo | 417/282 |
| 6,102,005 | A * | 8/2000 | Kasen et al. | 123/446 |
| 6,135,090 | A * | 10/2000 | Kawachi et al. | 123/446 |
| 6,488,479 | B1 * | 12/2002 | Berger | F01M 1/16 123/196 R |
| 6,837,123 | B2 * | 1/2005 | Hawkins | 74/457 |
| 7,263,972 | B2 * | 9/2007 | Tokuda et al. | 123/431 |
| 2005/0112012 | A1 * | 5/2005 | Marheineke | 418/191 |
| 2009/0041594 | A1 * | 2/2009 | Yokoi | F04C 2/14 417/310 |
| 2009/0120412 | A1 | 5/2009 | Tokuo et al. | |
| 2009/0208357 | A1 | 8/2009 | Garrett | |

FOREIGN PATENT DOCUMENTS

| | | | | |
|---|---|---|---|---|
| FR | 2 888 895 | A3 | 1/2007 | |
| JP | 56083589 | A * | 7/1981 | F04C 2/08 |
| JP | S5683589 | A | 7/1981 | |

* cited by examiner 120
t
t 1

122
t
t 1

44
66
66
46
t
t 1
t 3

Valve Actuator
124
t 1
t 2
t 3

Valve
Open
Closed
126
t 1
t 2

Pressure
P2
P1
128
t 1
t 2
t 3

220
t 222
t 44
66
66
46
t1
t2
t

Chamber Pressure
228
t

Common Rail Pressure
t

4 Cyl Engine Injection Timing
t

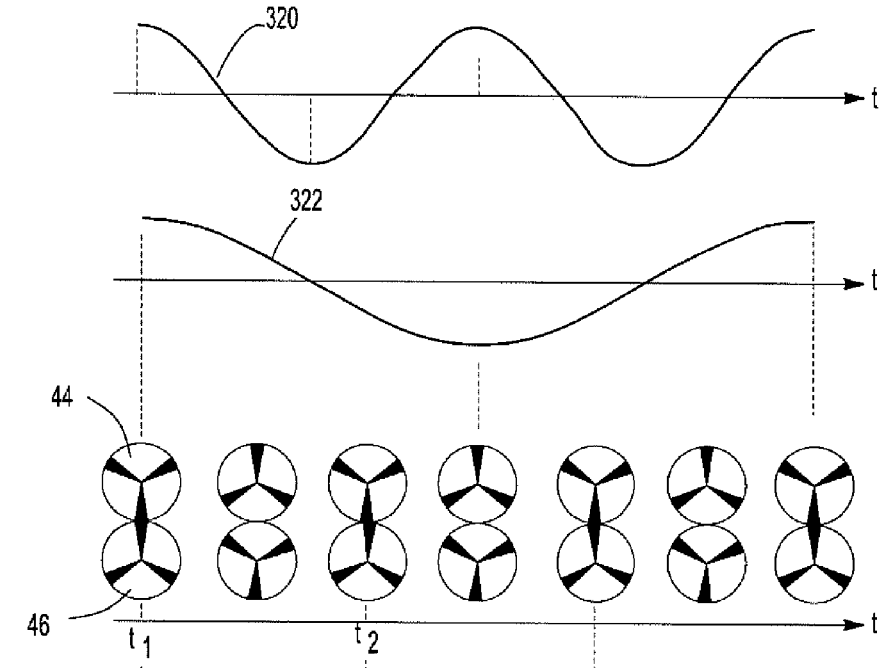
Fig-12a
Fig-12b
Fig-12c
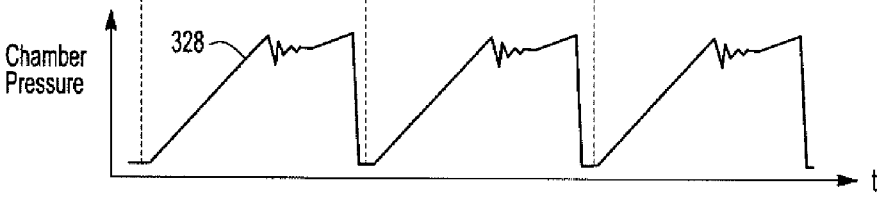
Fig-12d
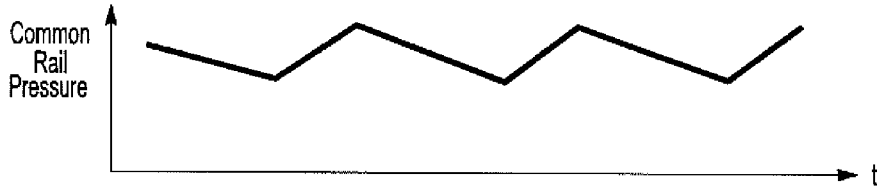
Fig-12e
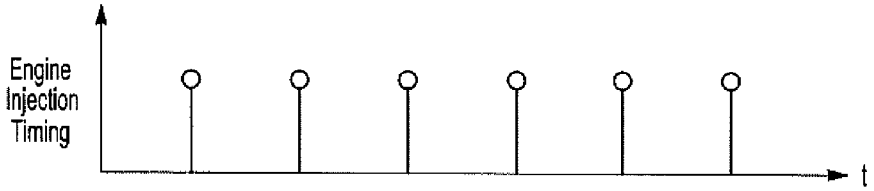
Fig-12f

FUEL PUMP FOR AN INTERNAL COMBUSTION ENGINE

BACKGROUND OF THE INVENTION

I. Field of the Invention

The present invention relates generally to pumps and, more particularly, to a fuel pump for an internal combustion engine and, particularly, a direct injection internal combustion engine.

II. Description of Related Art

There are different types of internal combustion engines used to propel automotive vehicles. However, direct injection internal combustion engines are becoming increasingly more common due to their fuel efficiency.

In a direct injection internal combustion engine, the fuel injector is open directly to the combustion chamber rather than upstream from the intake valves as in the previously known multipoint fuel injectors. Since the fuel injectors are open directly to the cylinders or combustion chambers of the engine, the fuel injectors are subjected to high pressure. As such, it is necessary to supply fuel to the fuel injector at a pressure which is not only sufficient to overcome the pressure of the internal combustion chamber, but also to atomize the fuel injection.

In order to provide high-pressure fuel to the fuel injectors, the previously known direct injection internal combustion engines have utilized a piston pump having a piston mounted in a pump chamber. Upon the intake stroke of the piston, the piston inducts fuel into the fuel chamber from a fuel source, such as a fuel tank. Conversely, upon the compression stroke of the piston, the piston extends into the pump chamber and pumps fuel out through a one-way check valve to a fuel outlet for the pump. This fuel outlet, in turn, is connected to a fuel rail which supplies the fuel to the fuel injectors for the engine.

One disadvantage of these previously known fuel pumps for direct injection engines, however, is that the aggressive pressure profile of the pump piston causes a water hammer effect when the check valve at the pump outlet opens and closes. This water hammer effect creates excessive noise, particularly at low engine speeds where the noise is much more noticeable to occupants of the vehicle.

A still further disadvantage of these previously known pumps for direct injection engines is that it is necessary to convert the rotational force of the cam into a linear force for the pump piston. This motion conversion results in excessive power consumption by the pump. This power consumption, of course, must be sustained by the engine thus resulting in a reduced engine efficiency.

A still further disadvantage of these previously known piston pumps for direct injection engines is that the force of the cam on the pump piston may result in material fatigue and pump failure after extended operation.

CITATION LIST

From Information Disclosure Statement

Patent Literature: US 2009/0208357 A1 and US 2009/0120412 A1

SUMMARY OF THE PRESENT INVENTION

The present invention provides a fuel pump for an internal combustion engine, and especially a direct injection internal combustion engine, which overcomes all of the above-mentioned disadvantages of the previously known pumps.

In brief, the fuel pump of the present invention comprises a housing which defines a pump chamber. Both a driven and an idler toothed gear are rotatably mounted within the pump chamber so that the driven and idler gears are in mesh with each other at a predetermined location in the pump chamber.

A fuel inlet is formed through the pump chamber and is open to an inlet subchamber on one side of the meshed driven and idler gears. Similarly, a fuel outlet is formed through the housing and is open to an outlet subchamber positioned in the housing chamber on the other side of the meshed driven and idler gears.

A pressure relief passageway, preferably formed through the housing, fluidly connects the inlet subchamber to the outlet subchamber. A valve is disposed in series with the pressure relief passageway and a control circuit controls the actuation of the valve between an open and a closed position.

In operation, the drive gear is rotatably driven by the engine in synchronism with the engine output shaft. The drive gear in turn rotatably drives the idler gear and pumps fuel from the inlet subchamber to the outlet subchamber. The outlet subchamber in turn is fluidly connected through a one-way check valve to the fuel rail for the engine.

In order to create the desired fuel pump pulsations corresponding to the fuel injectors, the control circuit selectively opens the pressure relief passageway which relieves pressure from the outlet subchamber to the inlet subchamber. Furthermore, the control circuit accurately controls the fuel pressure in the fuel rail by altering the timing and/or duration of the valve actuation in order to accommodate different engine operating conditions. In this fashion, the pressure relief valve is able to maintain constant fuel pressure during each fuel pressure pulsation at all different engine operating conditions.

In order to reduce the power consumption and workload of the pressure relief valve, preferably at least one tooth of both the driven and idler gears is notched so that, when the notched gears are in mesh with each other, a fluid passageway is formed through the notches which fluidly connects the outlet subchamber to the inlet subchamber and thus relieves pressure from the outlet subchamber.

The notches in the driven and idler gears are angularly oriented in the pump chamber so that the notched teeth are in mesh immediately after each fuel injection. Preferably, the number of notched teeth on both the driven and idler gears is equal to one half the number of cylinders in the internal combustion engine. Since there is only fuel injection for every two revolutions of the driven and idler gears, the notches create a pressure pulsation for each fuel injection of the four cycle internal combustion engine.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which:

FIG. 12 is a timing diagram for a six cylinder engine.

DETAILED DESCRIPTION OF A PREFERRED EMBODIMENT OF THE PRESENT INVENTION

Figure 1:
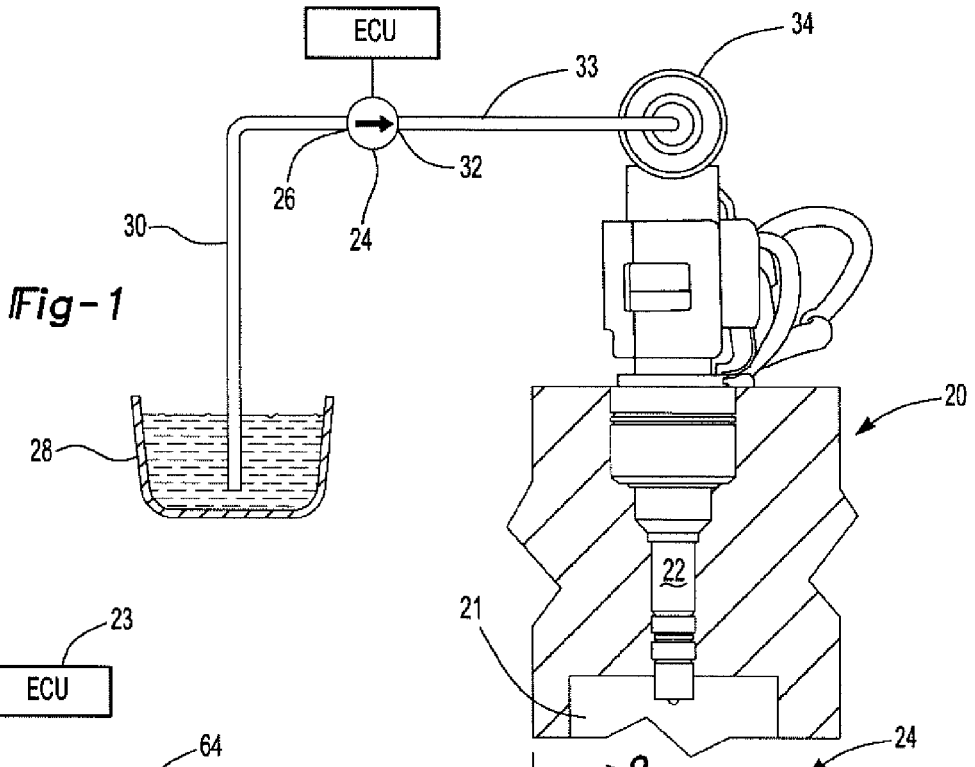
FIG. 1 is a diagrammatic view illustrating a direct injection internal combustion engine and the fuel pump.

With reference first to FIG. 1, a block diagrammatic view is shown having an internal combustion four-cycle engine 20 which is preferably a direct injection engine. As such, the engine 20 includes a plurality of fuel injectors 22 (only one shown), each of which is open directly to a combustion chamber or cylinder 21 in the engine 20.

In order to supply fuel to the fuel injectors 22, a fuel pump 24 has an inlet 26 fluidly connected to a fuel tank 28 by a fuel supply line 30. An outlet 32 from the fuel pump 24 is fluidly connected by a fuel line 33 to a fuel rail 34 which, in turn, is fluidly connected to the fuel injectors 22. An engine control unit (ECU) 23 controls both the timing and duration of activation of the fuel injectors 22 during the operation of the engine 20.

Figure 2:
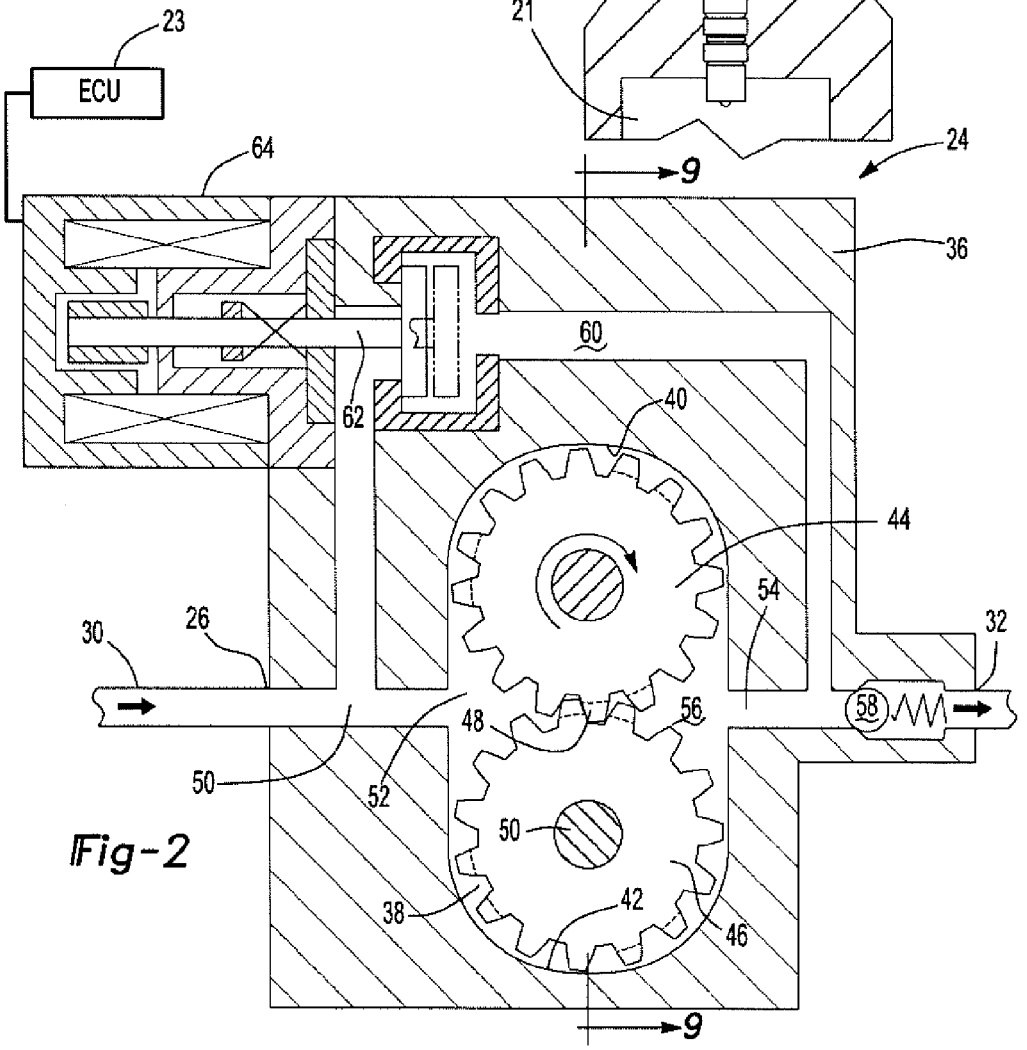
FIG. 2 is a sectional view illustrating a preferred embodiment.

With reference now to FIG. 2, a cross-sectional view of the fuel pump 24 is shown. The fuel pump includes a housing 36 which defines a pump chamber 38. The pump chamber 38 is elongated in shape and includes two semi-circular ends 40 and 42. The pump housing 36, furthermore, is constructed of any rigid material, such as metal.

A driven gear 44 and an idler gear 46 are both rotatably mounted within the pump chamber 38 so that the gears 44 and 46 are in mesh at a predetermined location 48 in the pump chamber 38. This predetermined position 48 or mesh position is preferably generally in the center of the pump chamber 38.

The driven gear 44 is rotatably driven in synchronism with the engine drive shaft. Since the driven gear 44 is in mesh with the idler gear 46, the driven gear 44 rotatably drives the idler gear 46 in synchronism with the driven gear 44. Both the driven gear 44 and idler gear 46, which are preferably substantially identical in shape to each other, include a plurality of circumferentially spaced teeth. These gears 44 and 46, furthermore, are dimensioned so that the outer periphery of the teeth is positioned closely adjacent the ends 40 and 42 of the pump chamber 38 during rotation.

Still referring to FIG. 2, a fluid passageway 50 fluidly connects the pump housing inlet 26 with an inlet subchamber 52 in the pump chamber 38. This inlet subchamber 52 is formed on one side of the meshed position 48 of the gears 44 and 46.

Similarly, an outlet passageway 54 is formed through the housing 36 and fluidly connects an outlet subchamber 56 to the pump outlet 32. The outlet subchamber 56 is part of the pump chamber 38 on the side of the meshed position 48 of the gears 44 and 46 opposite from the inlet subchamber 52.

A one way check valve 58 is provided in the fuel outlet passageway 54. The check valve 58 prevents a reverse flow of fuel from the fuel rail back into the pump chamber 38.

A pressure relief passageway 60 extends between and fluidly connects the outlet subchamber 56 with the inlet subchamber 52. This pressure relief passageway 60 is illustrated in the drawing as formed through the pump housing 36. However, the pressure relief passageway 60 may alternatively extend exteriorly of the pump housing 36.

A valve 62 is fluidly connected in series with the pressure relief passageway 60. The valve 62 is preferably actuated by an electromagnetic actuator 64 under control of the control circuit 23. The control circuit 23 controls both the timing and duration of actuation of the valve 62.

The valve 62 is movable between a closed position and an open position, illustrated in solid and phantom line in FIG. 2. In its closed position, the valve 62 prevents fluid flow through the pressure relief passageway 60. Conversely, in its open position, the valve 62 permits fluid flow from the outlet subchamber 56 to the inlet subchamber 52 thus reducing the pressure at the pump outlet 32.

The valve 62 shown in FIG. 2 is a normally closed valve so that the valve is in its closed position when the electromagnetic actuator 64 is not energized. Energization of the actuator 64 will move the valve 62 to its open position.

Figure 8:
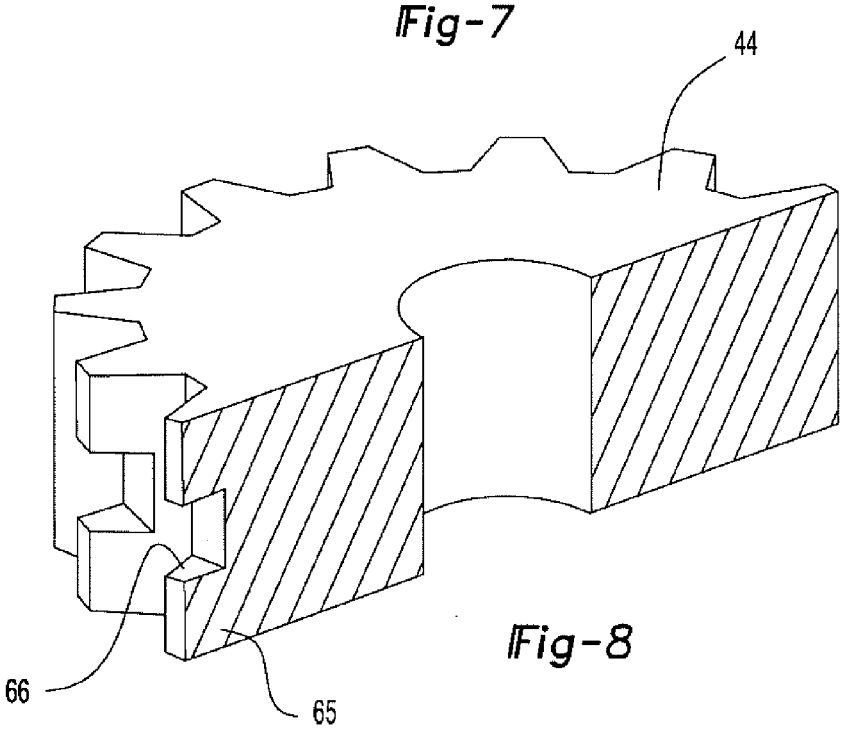
FIG. 8 is an elevational and partial sectional view illustrating the drive gear of the pump.
Figure 9:
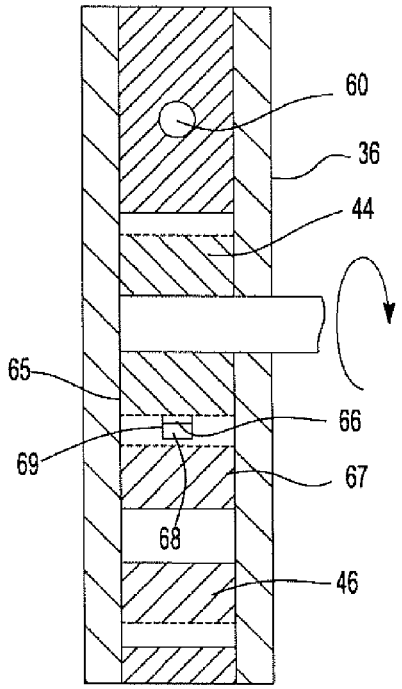
FIG. 9 is a sectional view taken along line 9-9 in FIG. 2.

With reference now to FIGS. 8 and 9, at least one tooth 65 of the drive gear 44 includes a notch 66 and, similarly, at least one tooth 67 of the idler gear 46 includes a notch 69. The drive gear 44 and idler gear 46, furthermore, are angularly oriented so that the notched teeth 65 and 67 of the drive gear 44 and notched gear 46, respectively, mesh each other during each revolution. When these notched gear teeth mesh, an opening 68 (FIG. 9) is formed between the gears 44 and 46 which allows fluid flow from the outlet subchamber 56 to the inlet subchamber 52 and, in doing so, release pressure from the outlet subchamber.

In order to reciprocally drive the piston, a multi-lobe cam is rotatably driven in synchronism with the drive shaft from the engine. The outer surface of the cam mechanically engages the piston so that, upon rotation of the cam, the piston is reciprocally driven in the pump chamber. Consequently, upon rotation of the cam, a series of pressure pulsations are formed at the pump outlet with each pressure pulsation synchronized with a lobe on the cam.

Direct injection engines are four-cycle engines so that there is one combustion cycle for each two reciprocations of a piston within its cylinder. Consequently, the number of lobes on the cam for the pump is equally to one half the number of cylinders so that each pressure pulsation from the fuel pump is synchronized with one fuel injection.

Preferably, the number of notches 66 and 67 formed in each gear 44 and 46, respectively, is equal to one half the number of cylinders in the engine. Consequently, one pair of spaced notches 66 and 67 will register with each other and relieve pressure from the outlet subchamber 56 to the inlet subchamber 52 in synchronization with each engine combustion.

The number of spaces made by the notches 66 and 67 on each gear 44 and 46, respectively, is equal to one half the number of cylinders in the engine. The number of spaces made by the notches 66 and 67 is also possible to equal to the number of cylinders in the engine. By matching the number of notch spaces with the number of cylinders, fuel injection is synchronized with the cycle of the pressure controlled by the spaces. Furthermore, the notches 66 and 67 on each gear 44 and 46 are equidistantly angularly spaced from each other. Consequently, the angular spacing between adjacent notches on each gear 44 and 46 is equal to 360 degree divided by one half the number of cylinders in the engine.

For example, for a six-cylinder engine, a notch is provided through three teeth in both the driven gear 44 and idler gear 46. These notches are angularly equidistantly spaced from each other and thus are circumferentially spaced by 120 degrees. Conversely, for an eight-cylinder engine, four notches are provided through both the driven gear 44 and idler gear 46 and these notches are spaced apart from each other by 90 degrees, or two notches are provided through both the driven gear 44 and idler gear 46 and these notches are spaced apart from each other by 180 degrees, and so on.

Figures 3A, 3B, 3C, 3D, 3E, 3F:
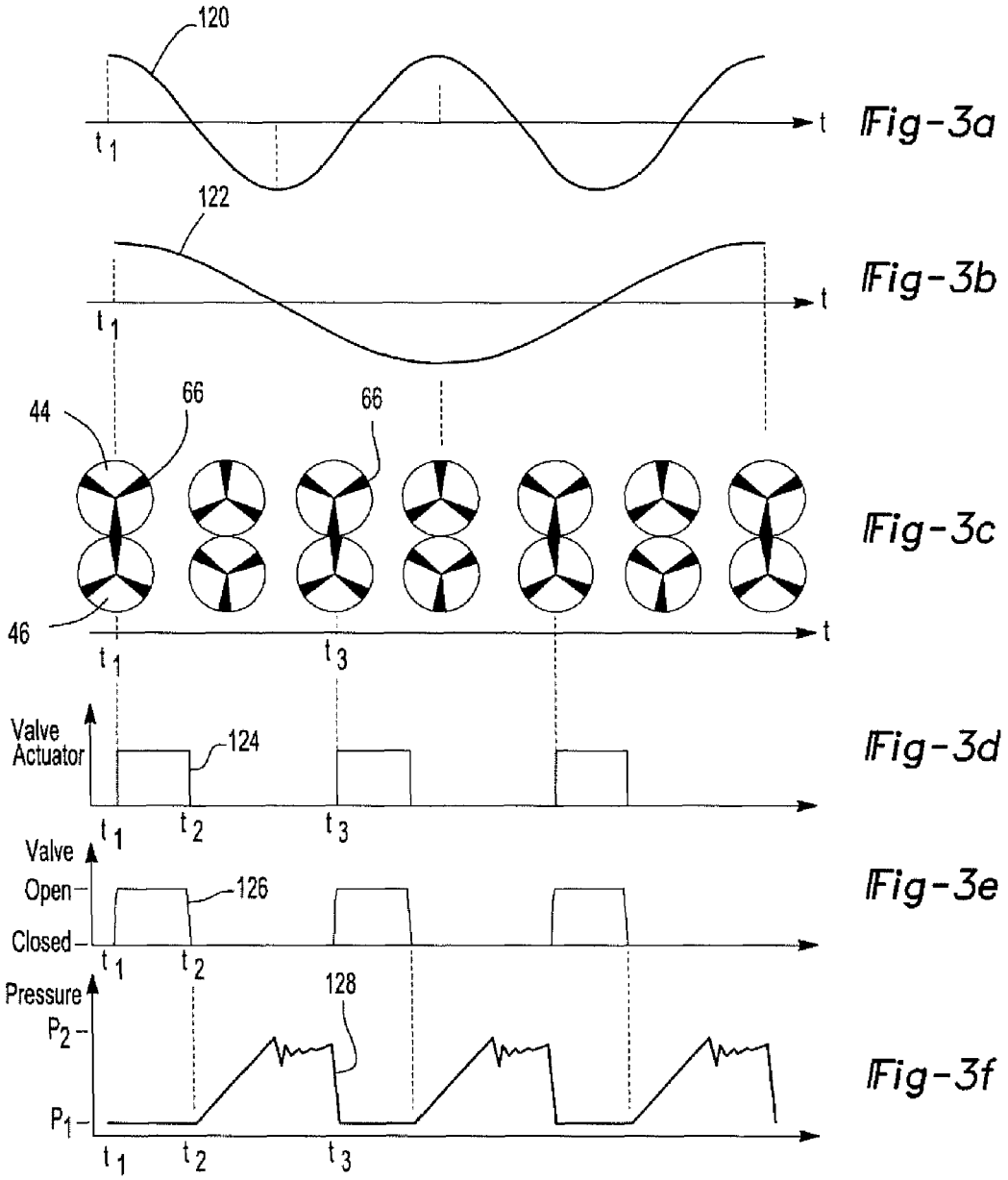
FIGS. 3*a*-3*f* are timing diagrams illustrating the operation for a normally closed valve.

With reference now to FIGS. 3*a*-3*f*, timing diagrams are shown illustrating the operation. The engine crank angle 120 is shown in FIG. 3*a* while the cam angle 122, which is half the rotation speed of the crank angle 120 but synchronized with the crank angle 120, is shown in FIG. 3*b*.

FIG. 3*c* illustrates the angular orientation of the driven gear 44 and idler gear 46 as well as the angular position of the notches 66 as a function of time. FIG. 3*d* illustrates the timing or drive signal 124 for the electromagnetic actuator 64 while FIG. 3*e* illustrates the position 126 of the valve 62. Lastly, graph 128 illustrates the fuel pressure in the outlet chamber 56.

Referring to FIGS. 3*c*-3*d*, at time $t_1$ the notches 66 register with each other and the control circuit sends a drive signal 72 to the actuator 64. This causes the actuator to move to its open position as shown at 76. Consequently, as shown in FIG. 3*f*, the combination of both the registration of the notches and the gear wheels 44 and 46 as well as the opening of the valve 62 causes the pressure in the outlet chamber 56 to drop to pressure $P_1$.

At time $t_2$ the electromagnetic driving signal 74 is terminated thus allowing the valve 62 to return to its closed position. In addition, at time $t_2$ the notches 66 have moved out of registration with each other. This causes the fuel pressure 128 (FIG. 3*f*) in the fuel outlet chamber 56 to ramp up to a high pressure $P_2$.

The pressure in the outlet subchamber 56 remains at the high pressure $P_2$ during the fuel injection into the engine. At the end of that high pressure period at time $t_3$, the notches 66 again register with each other and, simultaneously, the electromagnetic actuator driving signal 124 is activated thus opening the valve 62 and causing a pressure drop back to pressure $P_1$ after which the above cycle is repeated. The timing of the fuel injection is synchronized with the pressurized time prior to the registration of the spaced notches.

Figure 4:
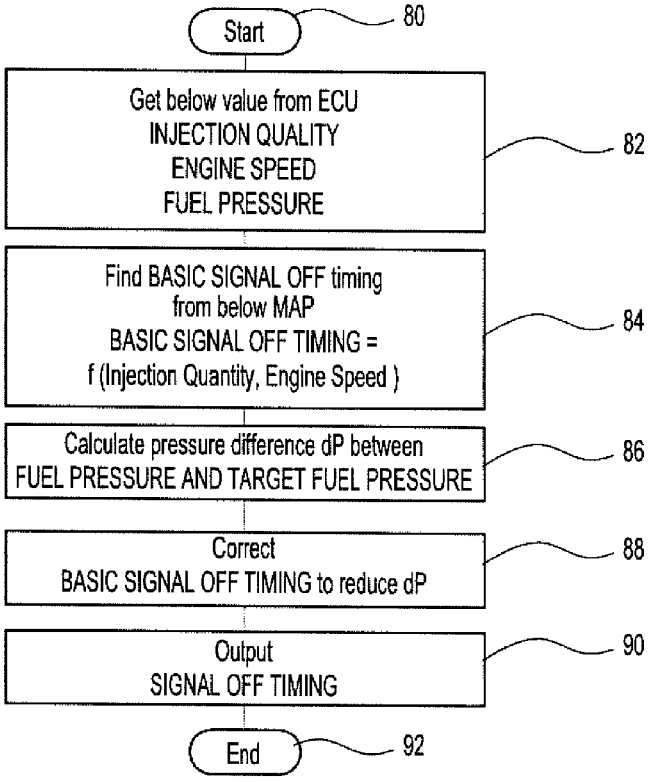
FIG. 4 is a flowchart illustrating the control of the off timing for the valve actuator.

With reference now to FIG. 4, a flowchart illustrating the operation of the fuel pump for a six cylinder engine is shown. The program is initiated at step 80 which then proceeds to step 82 where the ECU inputs the injection quantity, engine speed, and fuel pressure values. All three of these factors will affect the timing, duration, and necessary or desired pressure for the fuel injection. Step 82 then proceeds to step 84.

At step 84, the basic signal off timing for the valve 62 is determined as a function of the injection quantity and engine speed of the engine. Step 84 then proceeds to step 86.

At step 86, the ECU calculates the difference between the actual fuel pressure in the fuel rail and the target fuel pressure. Step 86 then proceeds to step 88 where the ECU corrects or modifies the basic valve actuator timing 124 for the valve actuator 64 in order to reduce the difference between the actual fuel pressure and the target fuel pressure. Step 88 then proceeds to step 90 and outputs the signal off timing and thus closure of the valve 62. Step 90 then proceeds to step 92 and terminates the procedure until the next valve actuation.

The pressure in the output subchamber 56 of the pump 24 may be controlled to accommodate different engine operating conditions by varying the initiation and/or duration of the actuation of the valve actuator 64. Consequently, by varying the duration of the valve actuation, the pressurization of the pump output may be adjusted to achieve a target value as determined by the ECU.

Figures 11A, 11B, 11C, 11D, 11E, 11F:
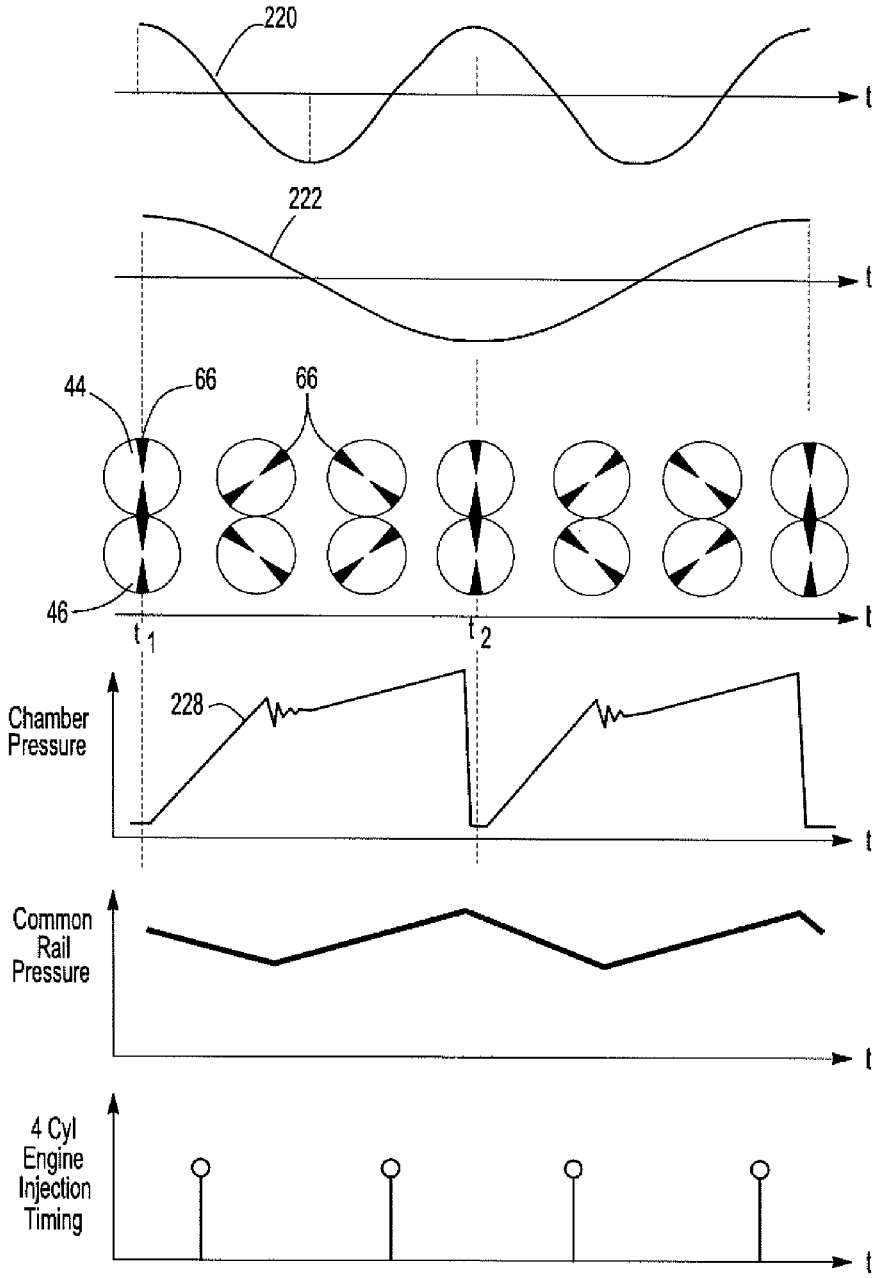
FIG. 11 is a timing diagram for a four cylinder engine.

With reference now to FIGS. 11*a*-11*f*, timing diagrams are shown illustrating the operation for a four cylinder engine. The engine crank angle 220 is shown in FIG. 11*a* while the cam angle 222, which is half the rotation speed of the crank angle 220 but synchronized with the crank angle 220, is shown in FIG. 11*b*. In addition, the pressure relief passageway 60 is closed.

FIG. 11*c* illustrates the angular orientation of the driven gear 44 and idler gear 46 as well as the angular position of the notches 66 as a function of time. FIG. 11*f* illustrates the injection timing.

FIG. 11*d* illustrates the chamber pressure 228 while FIG. 11*e* illustrates the fuel rail pressurization 230. Common rail pressure is synchronized with the cycle of the chamber pressure, and fuel injection is made at the constant pressurized timing in the common rail pressure.

Referring to FIGS. 11*c*-11*d*, at time $t_1$ the notches 66 register with each other and cause a reduction in the pump output chamber 228. The pressure 228 then increases until time $t_2$ when the notches 66 and 67 again registers which again exhausts the chamber pressure 228 and the process is repeated.

With reference now to FIGS. 12*a*-12*f*, timing diagrams are shown illustrating the operation for a six cylinder engine. The engine crank angle 320 is shown in FIG. 12*a* while the cam angle 322, which is half the rotation speed of the crank angle 320 but synchronized with the crank angle 320, is shown in FIG. 12*b*. In addition, the pressure relief passageway 60 is closed.

FIG. 12*c* illustrates the angular orientation of the driven gear 44 and idler gear 46 as well as the angular position of the notches 66 as a function of time. FIG. 12*f* illustrates the injection timing.

FIG. 12*d* illustrates the chamber pressure 328 while FIG. 12*e* illustrates the fuel rail pressurization 330. Common rail pressure is synchronized with the cycle of the chamber pressure, and fuel injection is made at the constant pressurized timing in the common rail pressure.

Referring to FIGS. 12*c*-12*d*, at time $t_1$ the notches 66 register with each other and cause a reduction in the pump output chamber 328. The pressure 328 then increases until time $t_2$ when the notches 66 and 67 again registers which again exhausts the chamber pressure 328 and the process is repeated.

Figure 5:
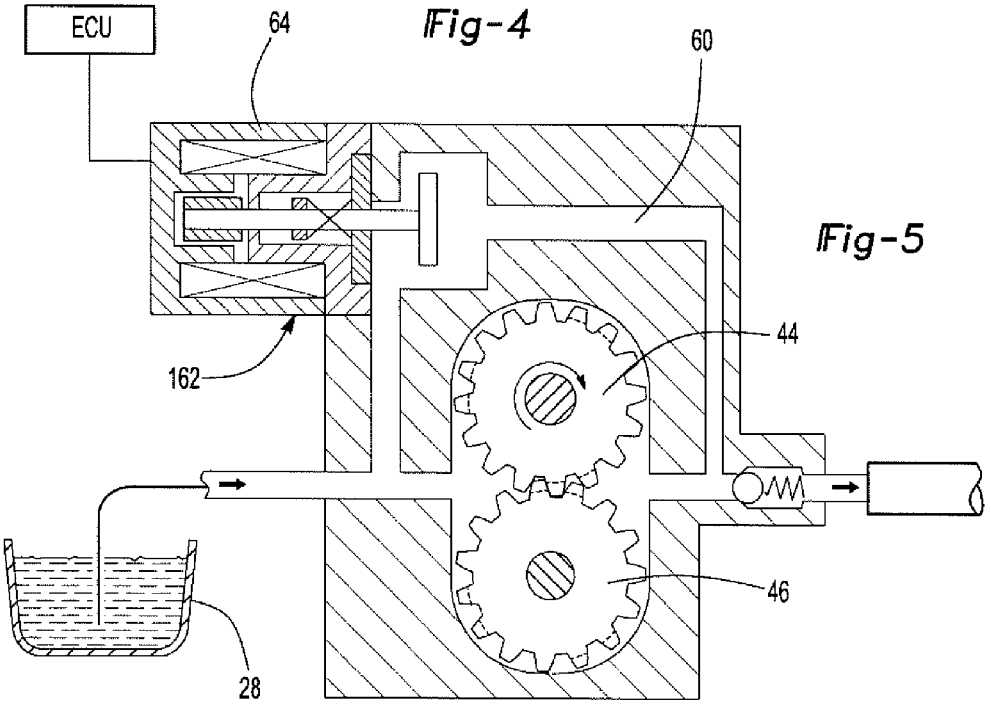
FIG. 5 is a sectional view similar to FIG. 2, but illustrating a modification thereof for a normally open valve.
Figures 6A, 6B, 6C, 6D, 6E, 6F:
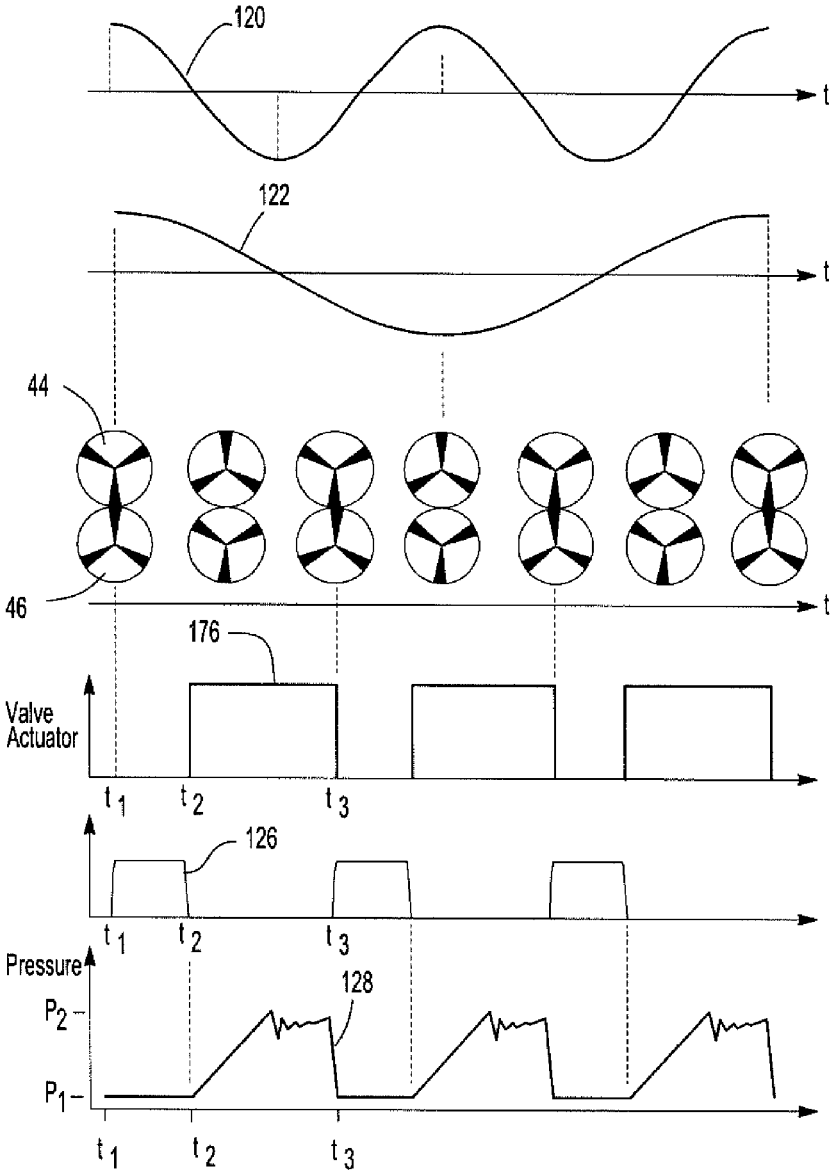
FIGS. 6*a*-6*f* are timing diagrams similar to FIGS. 3*a*-3*f*, but for the modification of FIG. 5.

A modification is shown in FIG. 5 in which a normally open valve 162 replaces the normally closed valve 62 shown in FIG. 2. Consequently, the valve 162 is illustrated in FIG. 5 with the electromagnetic actuator 64 deenergized. In this position, the valve 162 establishes fluid communication through the pressure relief passageway 60. Conversely, upon energization of the electromagnetic actuator 64 by the control circuit, the valve 162 extends rightwardly as shown in FIG. 4 thus closing the relief pressure passageway 60 as shown in phantom line.

With reference now to FIGS. 6*a*-6*f*, timing diagrams similar to FIGS. 3*a*-3*f* are illustrated. However, the electromagnetic actuator driving signal 176 is exactly the opposite from the driving signal 124 of FIG. 3*d*. Consequently, the previous description with respect to FIGS. 3*a*-3*c* and 3*e*-3*f* equally applies to FIGS. 6*a*-6*c* and 6*e*-6*f* and is incorporated by reference.

Figure 7:
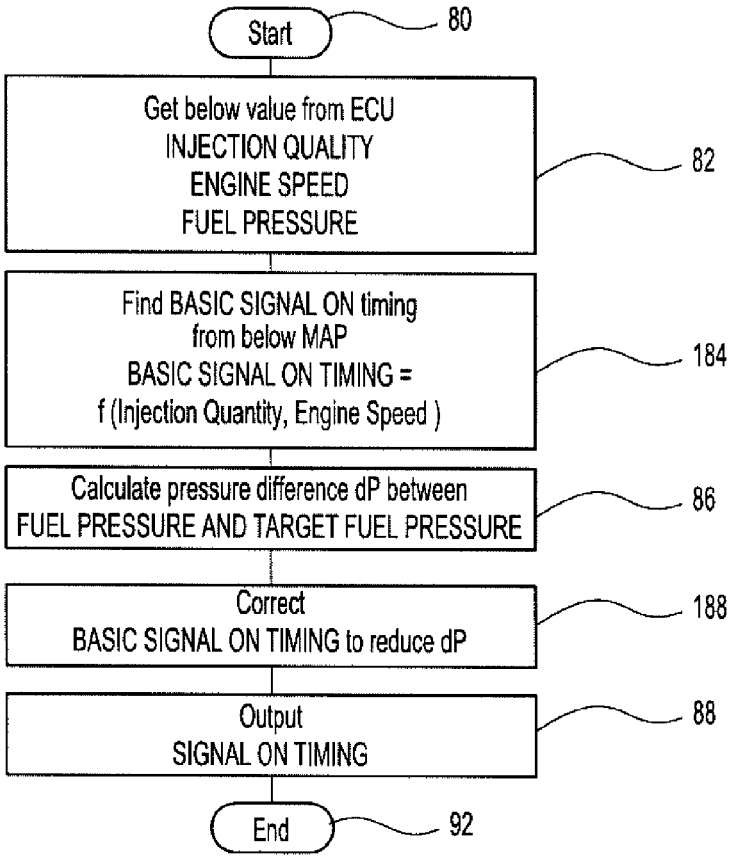
FIG. 7 is a flowchart illustrating the operation of the valve actuation signal for the modification of FIG. 5.

With reference now to FIG. 7, a flowchart used in connection with the normally open return valve 162 (FIG. 5) is illustrated which allows the duration of the valve closure to be varied to maintain a target fuel output pressure despite changing engine conditions. Steps 80 and 82 are identical to FIG. 4. However, step 184 replaces step 84 in FIG. 4. In step 184 the drive signal for the on signal of the electromagnetic actuator 64 is determined by the ECU 23 as a function of the injection quantity and the engine speed. Step 184 then proceeds to step 86 where, as before, the ECU 23 calculates the pressure difference between the actual fuel pressure and a target fuel pressure. Step 86 then proceeds to step 188.

Step 188 differs from step 88 in FIG. 4 in that the basic signal "on" timing to reduce the pressure differential between the actual and target fuel pressure is calculated by the ECU. Step 88 then proceeds to step 190 and outputs the signal on timing to move or actuate the normally open valve to its closed position. Step 90 then proceeds to step 92 to exit from the routine.

Figure 10:
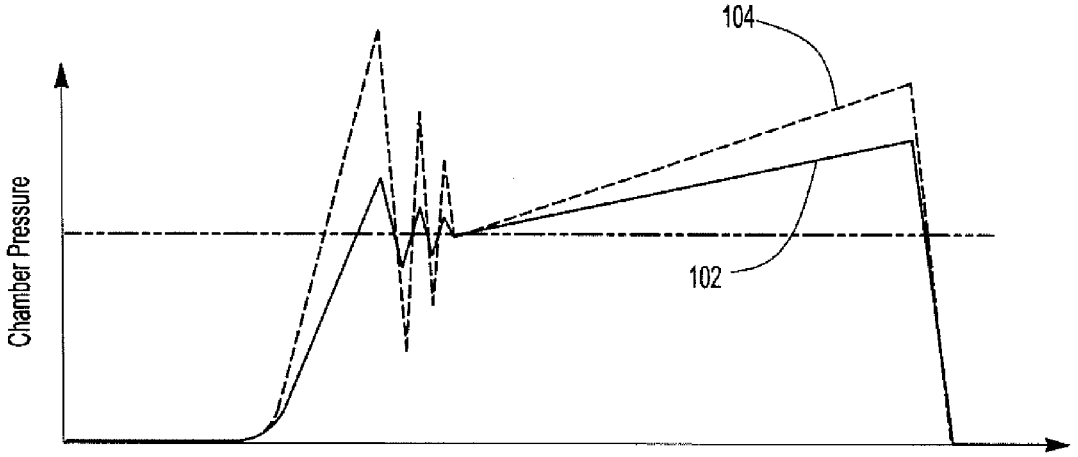
FIG. 10 is a graphical view comparing the fuel pressure pulse of the pump with the previously known piston pumps.

With reference now to FIG. 10, graph 102 illustrates the pressure pulsation of the pump output while graph 104 illustrates the pressure pulsation of the pump output for the previously known piston pumps. As is clear from FIG. 10, the magnitude of pressure variations of graph 102 is much less than graph 104 which results in less metal fatigue and less noise caused by a water hammer effect from the pump.

From the foregoing, it would be seen that the present embodiment provides an effective fuel pump for an internal combustion engine and, particularly, for a direct injection internal combustion engine which not only reduces noise caused by water hammer, but also material fatigue. Furthermore, the present embodiment allows careful control of the output pressure from the pump to meet a target pressure by merely adjusting the duration of the opening or closure of the valve 62 or 162, respectively, as a function of different engine operating conditions.

Although the valve 62 or 162 may, alone, be sufficient to control the output pressure from the pump, in the preferred embodiment the notches 66 and 69 formed in the driven gear 44 as well as the idler gear 46, respectively, are employed to reduce the pressure in the outlet subchamber in synchronism with the fuel injection by the fuel injectors. The addition of the notches effectively reduces the power consumption by the valve actuator 64 as well as mechanical wear and tear on the valves.

Having described our invention, however, many modifications thereto will become apparent to those skilled in the art to which it pertains without deviation from the spirit of the invention as defined by the scope of the appended claims.

We claim:

1. A fuel pump comprising:

a housing defining a pump chamber, a driven and an idler toothed gears rotatably mounted in said pump chamber so that said driven and idler gears mesh with each other at a predetermined location in said pump chamber, a fluid inlet formed through said housing and open to an inlet subchamber of said pump chamber, said inlet subchamber being positioned at one side of said predetermined location, a fluid outlet formed through said housing and open to an outlet subchamber of said pump chamber, said outlet subchamber being positioned at the other side of said predetermined location, a pressure relief passageway which fluidly connects said inlet subchamber to said outlet subchamber, a valve disposed in series with said pressure relief passageway, and a control circuit which controls an actuation of said valve between an open and a closed position, wherein said driven gear and said idler gear have the same number of teeth, wherein at least two angularly spaced teeth of said driven gear and at least two angularly spaced teeth of said idler gear each have a through notch, said driven and idler gears being angularly oriented so that the notched teeth in both said driven gear and said idler gear mesh each revolution of the gears and fluidly connect said inlet subchamber to said outlet subchamber at a plurality of different angular positions of said gears.

2. The fuel pump as defined in claim 1 and comprising a one-way valve fluidly connected in series with said fluid outlet.

3. The fuel pump as defined in claim 1 wherein said pressure relief passageway is formed in said housing.

4. The fuel pump as defined in claim 1 wherein the fuel pump delivers fuel to an engine and each through notch forms a space and wherein the number of spaces made by the notched teeth in both said driven and idler gears is equal to the number of cylinders or one half the number of cylinders in the engine.

5. The fuel pump as defined in claim 4 wherein said pressure relief passageway is formed in said housing.

6. The fuel pump as defined in claim 1 wherein the notched teeth in both said driven and idler gears comprise one pair of circumferentially equidistantly spaced notches will register with each other and relieve pressure from the outlet subchamber to the inlet subchamber in synchronization with each engine combustion.

7. The fuel pump as defined in claim 1 wherein the fuel pump delivers fuel to an engine and the angular spacing between the notched teeth is equal to 360 degrees divided by the number of cylinders in the engine.

8. A fuel pump for a direct injection internal combustion engine comprising:

a housing defining a pump chamber, a driven and an idler toothed gears rotatably mounted in said pump chamber so that said driven and idler gears mesh with each other at a predetermined location in said pump chamber, a fluid inlet formed through said housing and open to an inlet subchamber of said pump chamber, said inlet subchamber being positioned at one side of said predetermined location, a fluid outlet formed through said housing and open to an outlet subchamber of said pump chamber, said outlet subchamber being positioned at the other side of said predetermined location, a pressure relief passageway which fluidly connects said inlet subchamber to said outlet subchamber, a valve disposed in series with said pressure relief passageway, and a control circuit which controls an actuation of said valve between an open and a closed position, wherein said driven gear and said idler gear have the same number of teeth, wherein at least two angularly spaced teeth of said driven gear and at least two angularly spaced teeth of said idler gear each have a through notch, said driven and idler gears being angularly oriented so that the notched teeth in both said driven gear and said idler gear mesh each revolution of the gears and fluidly connect said inlet subchamber to said outlet subchamber at a plurality of different angular positions of said gears and the fuel pump supplies fuel to a fuel injector.

9. The fuel pump as defined in claim 8 wherein said drive gear is rotatably driven in synchronism with the rotation of the engine.

10. The fuel pump as defined in claim 8 and comprising a one-way valve fluidly connected in series with said fluid outlet.

11. The fuel pump as defined in claim 10 wherein the engine is a multi piston four cycle engine and wherein a number of notched teeth in each gear is equal to one half the number of pistons in the engine.

12. The fuel pump as defined in claim 8 wherein the number of spaces made by the notched teeth formed in each driven and idler gear is equal to the number of cylinders or one half the number of cylinders in the engine.

* * * * *